US005385445A

United States Patent [19]

McKenna

[11] Patent Number: 5,385,445

[45] Date of Patent: Jan. 31, 1995

[54] CENTRIFUGAL PUMP

[75] Inventor: John M. McKenna, Port Murray, N.J.

[73] Assignee: Ingersoll-Dresser Pump Company, Liberty Corner, N.J.

[21] Appl. No.: 161,965

[22] Filed: Dec. 3, 1993

[51] Int. Cl.[6] ..... F04D 1/08; F04D 29/44

[52] U.S. Cl. ..... 415/199.2; 415/199.3; 415/214.1; 415/229

[58] Field of Search ..... 415/199.1, 199.2, 199.3, 415/208.3, 208.2, 209.1, 214.1, 229

[56] References Cited

U.S. PATENT DOCUMENTS

| | | | |
|---|---|---|---|
| 1,822,945 | 9/1931 | Weis . | |
| 2,366,964 | 1/1945 | Howard . | |
| 3,051,090 | 8/1962 | Zumbusch | 415/199.1 |
| 3,288,074 | 11/1966 | Hall | 415/199.3 |
| 3,477,384 | 11/1969 | Hlinka . | |
| 3,715,176 | 2/1973 | Kerklo . | |
| 3,730,641 | 5/1973 | Gordon . | |
| 3,927,763 | 12/1975 | Strub et al. | 415/199.2 |
| 4,098,558 | 7/1978 | Bush et al. | 415/199.1 |
| 4,244,675 | 1/1981 | Bower | 415/199.1 |
| 4,741,668 | 5/1988 | Bearden . | |
| 4,781,531 | 11/1988 | James . | |
| 5,320,489 | 6/1994 | McKenna | 415/199.1 |

FOREIGN PATENT DOCUMENTS

| | | | |
|---|---|---|---|
| 1050253 | 1/1954 | France | 415/199.1 |

*Primary Examiner*—Edward K. Look
*Assistant Examiner*—James A. Larson
*Attorney, Agent, or Firm*—Michael H. Minns

[57] ABSTRACT

A multi-stage open impeller centrifugal pump, primarily used for charging service. The pump uses multivane, 27 vanes, impellers, mounted on a single shaft. Rotor parts are a loose fit to the pump shaft and channel rings are pulled together with bolts. Jackbolts are used to separate the channel rings. A channel ring bushing is provided with a loose fit. The channel ring bushing is axially and radially retained by the channel ring and diffusor.

13 Claims, 9 Drawing Sheets

CENTRIFUGAL PUMP

BACKGROUND OF THE INVENTION

This invention relates generally to centrifugal pumps and more particularly to multi-stage centrifugal pumps.

Captured casing rings and bushings are normally found in horizontally split pumps such as a single stage double suction pump and multi-stage volute pumps. Channel ring bushings are usually shrunk fit into a channel ring or diffuser and then locked in position with set screws drilled and tapped on the joint line, with large head screws in a milled recess, welded in place or bolted in place. Replacement of this part can be difficult in the field. Particularly if radiation is involved. Contaminated parts have to be ground or machined for removal, releasing airborne contamination. The bolted in part partially solves this problem, but it is large and can not be used on channel ring bushings in a compact design.

Typically, channel rings use an interference fit with the pump casing to retain the channel rings in place. Because of the interference fit, these channel rings are difficult to remove. Disassembly can be a time consuming operation.

The foregoing illustrates limitations known to exist in present multi-stage centrifugal pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a multi-stage centrifugal pump comprising: a pump housing having an inlet and an outlet; and a plurality of pump stages within the pump housing, a pump stage comprising a diffuser, a channel ring, a biasing means for biasing the diffuser into contact with the channel ring and a rotatable impeller; each channel ring being a disk shaped member having a central opening therethrough, the outer periphery of the channel ring having a raised portion defining a circular rim, the circular rim having an inner diameter, the circular rim having an axial thickness; each diffuser being a disk shaped member having a central opening therethrough, the outer diameter of the diffuser being smaller than the inner diameter of the channel ring rim, the outer diameter of the diffuser being larger than the diameter of the channel ring circular central opening, the axial thickness of the diffuser being smaller than the axial thickness of the channel ring rim, the diffuser fitting with a non-interference fit within the circular rim of the channel ring.

In a second aspect of the present invention, this is accomplished by providing a multi-stage centrifugal pump comprising: a pump housing having an inlet and an outlet; a plurality of pump stages within the pump housing, a pump stage comprising a diffuser, a channel ring, a channel ring bushing and a rotatable impeller; a restraint means for axially restraining each channel ring bushing; and an interengaging means for rotationally restraining each channel ring bushing.

In a third aspect of the present invention, this is accomplished by providing a multi-stage centrifugal pump comprising: a pump housing having an inlet and an outlet; a plurality of pump stages within the pump housing, a pump stage comprising a diffuser, a channel ring and a rotatable impeller; and each channel ring being a disk shaped member having a central opening therethrough, the outer periphery of the channel ring having a raised portion defining a circular rim, the circular rim having a series of holes therethrough, a series of threaded apertures therethrough, and a series of recesses spaced thereabout, the holes being equally spaced from one another, the apertures being equally spaced from one another, the recesses being equally spaced from one another, a hole being radially positioned from an adjacent threaded aperture a predetermined radial distance and being radially positioned from an adjacent recess by said radial distance, a first channel ring being removeably attached to an adjacent second channel ring by a plurality of bolts inserted through said holes in said first channel ring and engaging said threaded apertures in said second channel ring.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

The channel ring bushing of the present invention is held between the channel ring and diffusor of a multi-stage pump. The channel ring has return vanes which face the channel ring bushing. The diffusor and channel ring are two separate parts. Removal of the channel ring allows removal of the diffusor and channel ring bushing. The channel ring bushing can be a loose fit or shrink fit into the diffusor. A shoulder on the channel ring bushing prevents axial motion of the channel ring bushing. Replacement is done by pressing out the channel ring bushing if shrunk in or pushing out by hand if loose.

The channel rings and diffuser are a loose fit for ease of assembly and disassembly. Bolts are used to fasten one channel ring to an adjacent channel ring. These bolts are also used as jacking bolts to separate the channel rings for disassembly.

Figure 1:
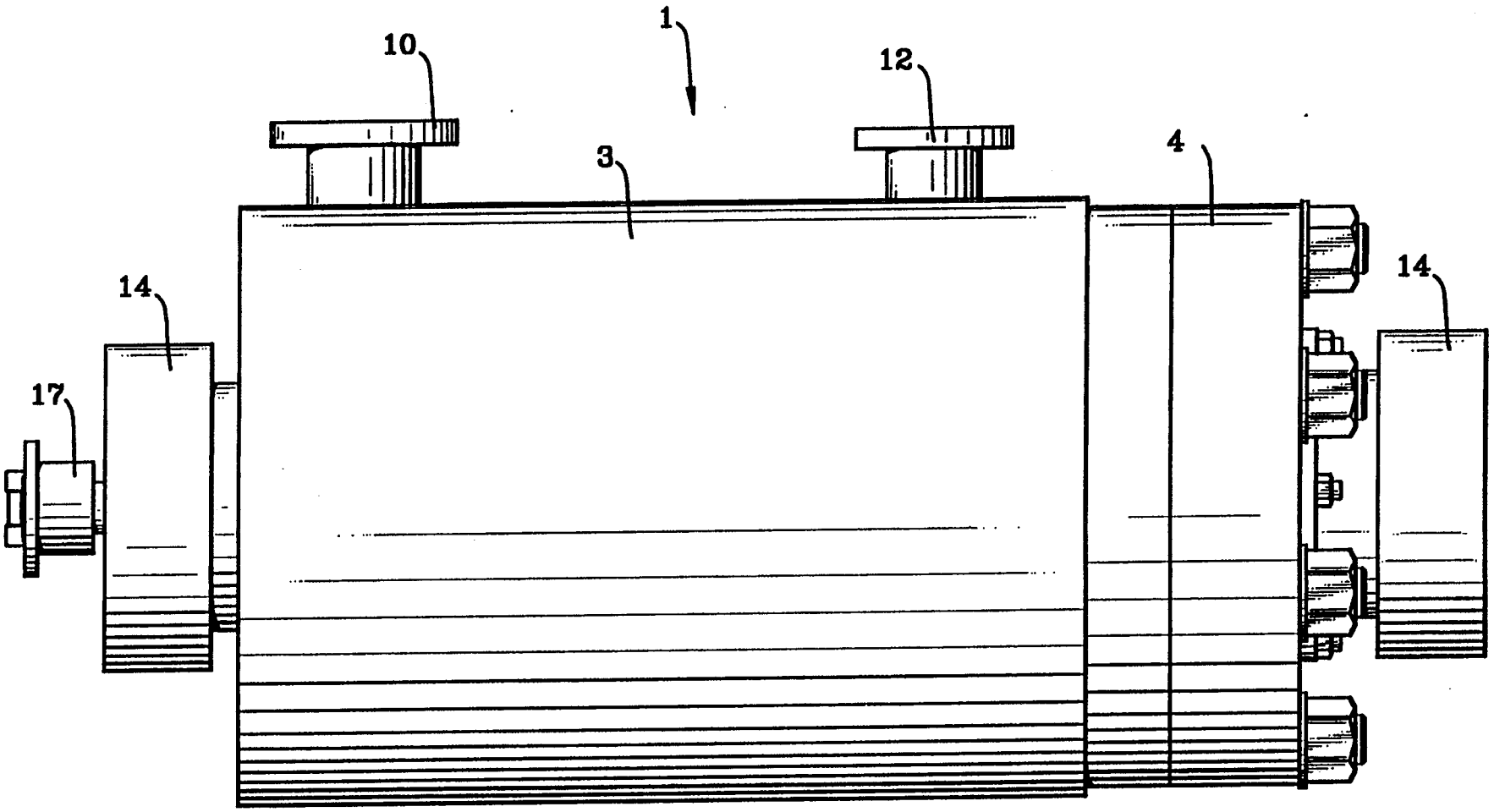
FIG. 1 is a side view of a multi-stage centrifugal pump.

FIG. 1 shows a multi-stage centrifugal pump 1 having an inlet 10 and outlet 12. The interior of the centrifugal pump 1 contains a plurality of multiple stages consisting of an impeller 15 attached to a rotating shaft 20, a diffuser 22, a channel ring bushing 60, a load ring or spring 26 and a channel ring with return vanes 24. These multiple stages are enclosed within a pump housing 3. One end of the centrifugal pump 1 is closed by a pump end casing 4 bolted to the pump housing 3. At each end of the centrifugal pump 1 is a bearing housing 14. The shaft 20 is provided with a coupling 17 for connecting the pump 1 to a driving device (not shown) such as an electric motor, steam driven turbine or gas turbine.

Figure 2:
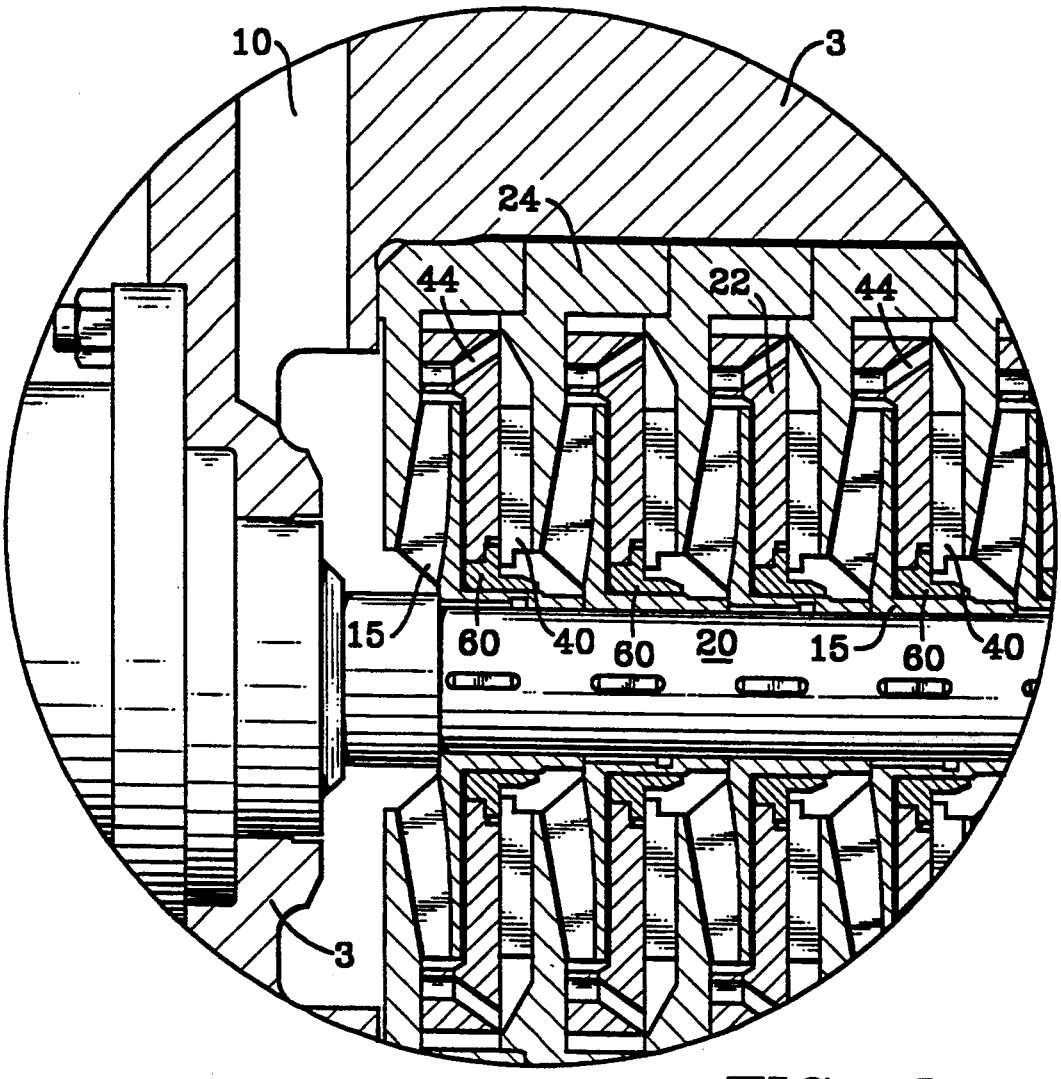
FIG. 2 is a cross-section of a portion of the multi-stage centrifugal pump shown in FIG. 1.
Figure 10:
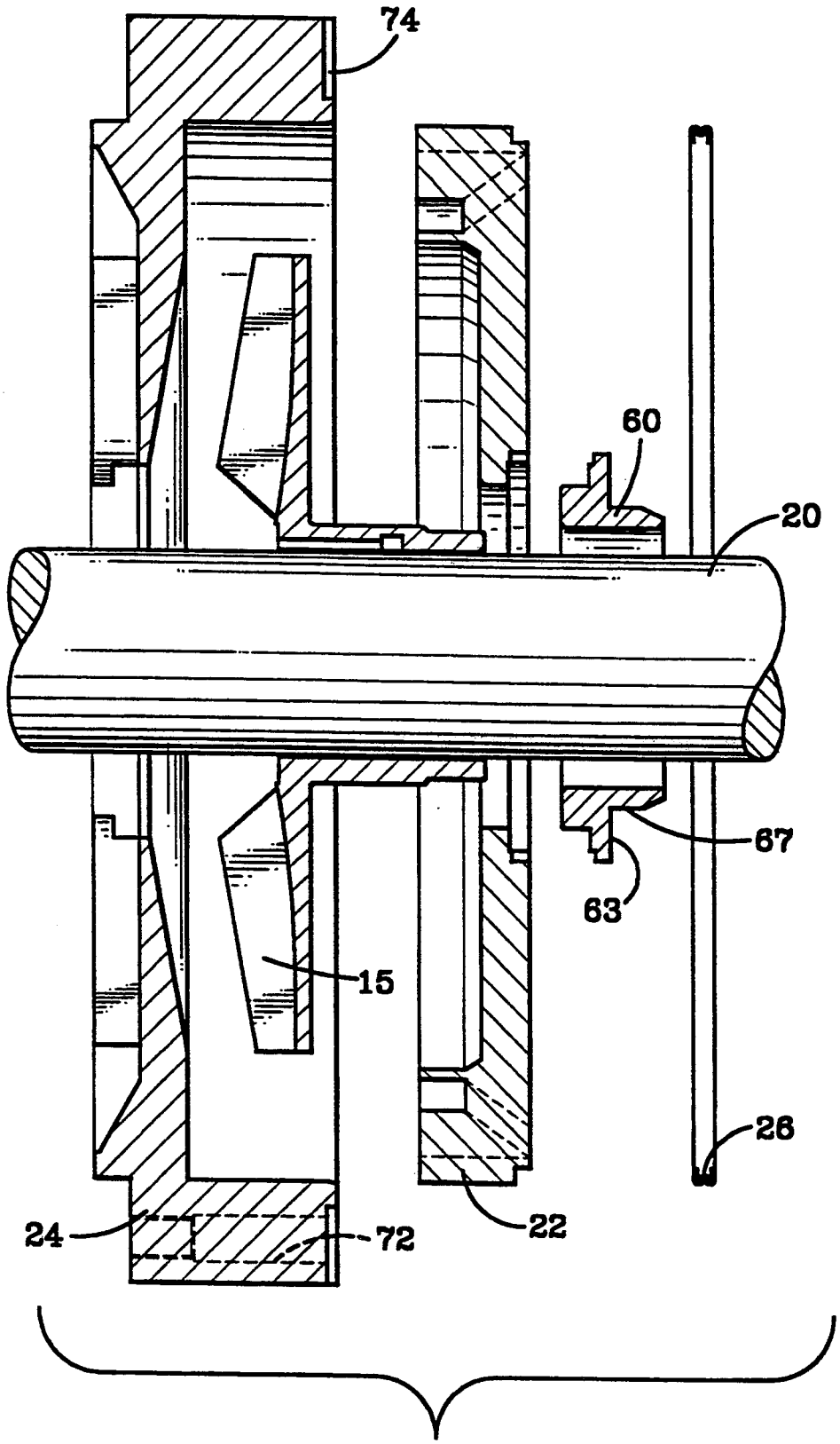
FIG. 10 is an exploded cross-section showing the components of a single pumping stage.

An enlarged view of several stages of the pump internals is shown in FIG. 2. FIG. 10 shows an exploded view of one pumping stage. The pumped fluid enters an impeller 15 attached to a shaft 20. The preferred impeller is an open multi-vane impeller such as the impeller described in U.S. Pat. No. 4,890,980. The rotating impeller increases the fluid velocity. The fluid exits the impeller 15 and flows into a diffuser 22 where the increased velocity is converted to increased pressure. The higher pressure fluid then enters a channel ring section 24 containing a plurality of return vanes 40 which guide the fluid to the next stage impeller 15. Additional stages are used as necessary to achieve the required discharge pressure. The stages shown in FIG. 2 are from a twelve stage centrifugal pump.

Figure 3:
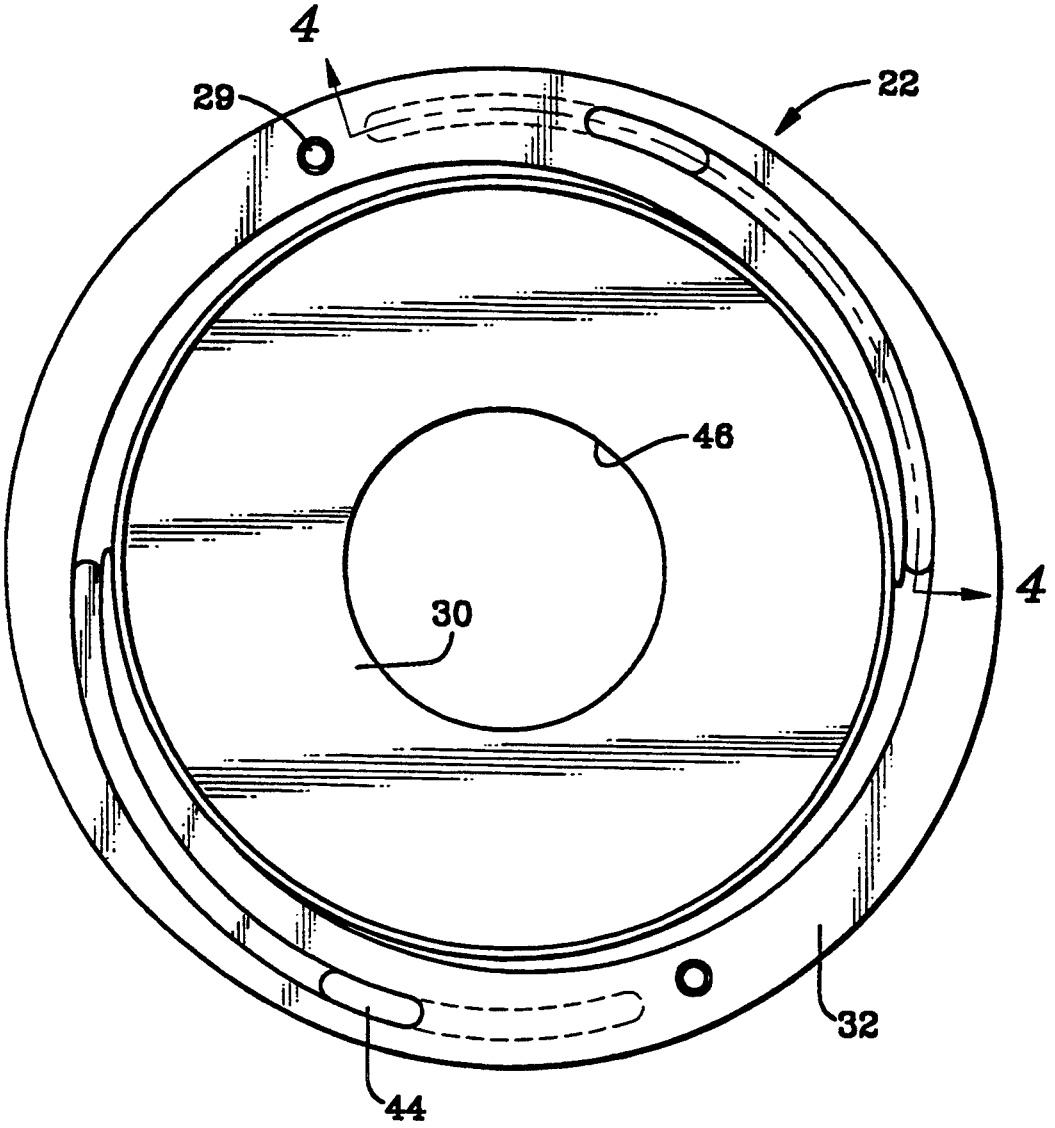
FIG. 3 is a top view of the pump diffuser shown in FIG. 2.
Figure 4:
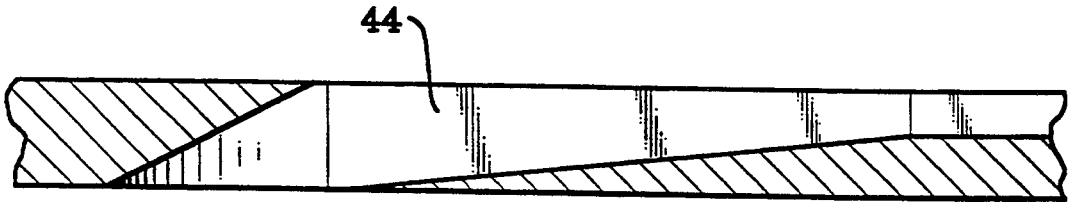
FIG. 4 is a cross-section of a diffuser passage taken along line 4—4 of FIG. 3.

FIG. 3 shows the diffuser 22 from FIG. 2. The diffuser 22 is an annular disk 30 with a thicker integral ring portion 32 at its outer circumference. The inner circumference 46 of the annular disk 30 forms an opening for the pump impeller shaft 20. A pair of holes 29 are located in the ring portion 32. The holes 29 correspond to a pair of complementary holes 28 on the channel ring 24. These holes 28, 29 accept an anti-rotation pin (not shown) which prevents rotation of the diffuser 22. A plurality of diffuser passages 44 are located in the ring portion 32. FIG. 3 shows two long diffuser passages 44. FIG. 4 shows a cross sectional view of the diffuser passage 44. The preferred embodiment of the diffuser 22 is described in U.S. Pat. No. 5,320,489.

Figure 5:
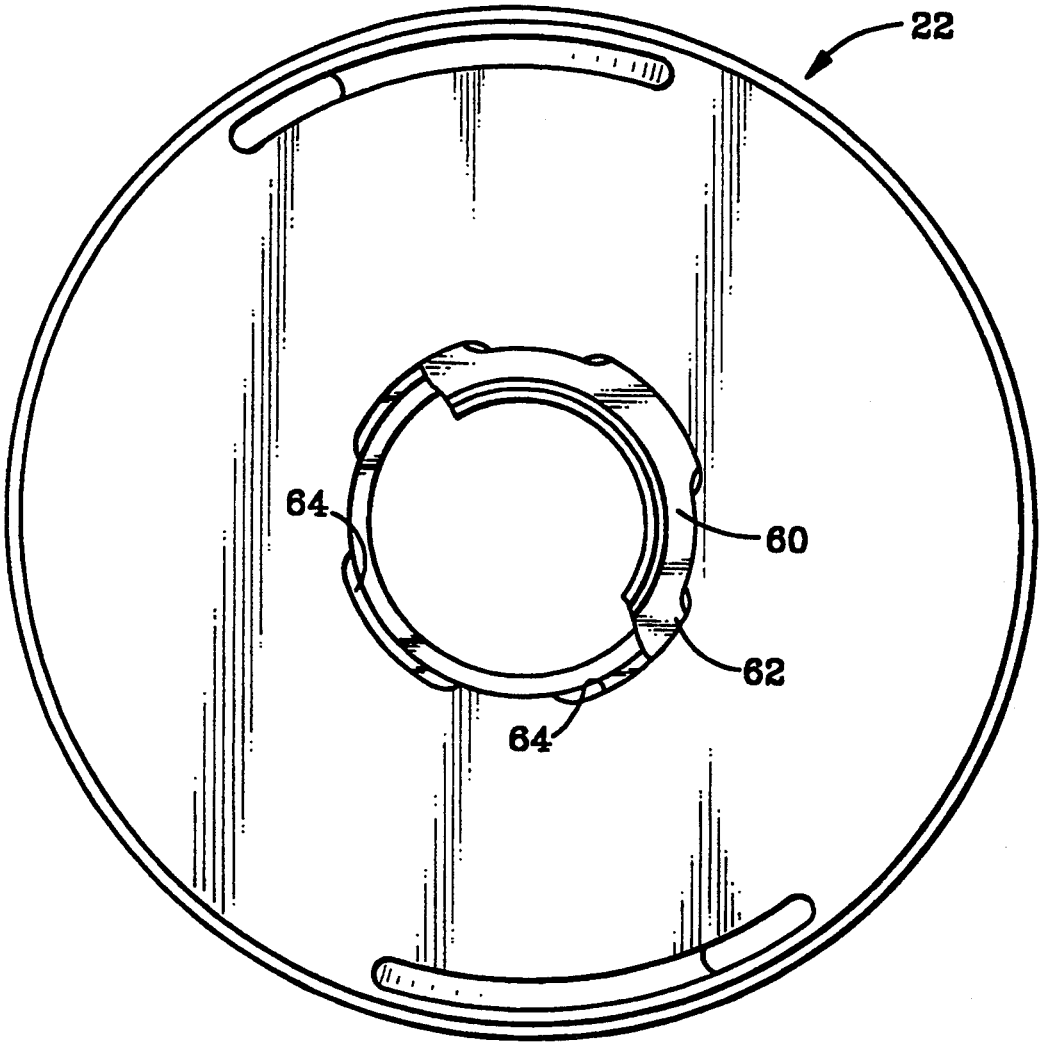
FIG. 5 is a bottom view of the diffuser shown in FIG. 3.
Figure 8:
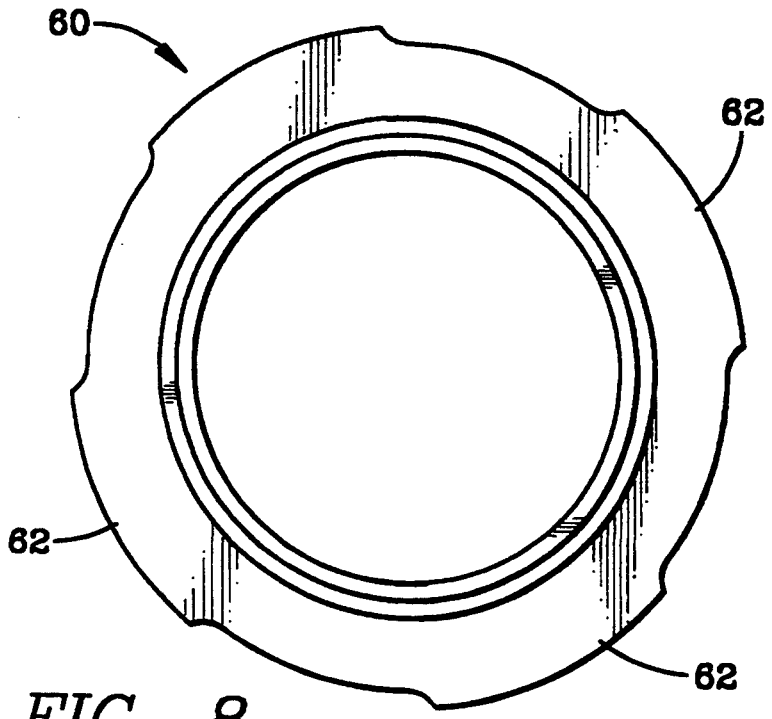
FIG. 8 is a bottom view of a channel ring bushing.

FIG. 5 shows a bottom view of the diffuser 22 shown in FIG. 3 with part of the channel ring bushing 60 in place. Four anti-rotation apertures 64 are machined or cast in the diffuser 22 adjacent the inner circumference 46 of the annular disk diffuser 22. The anti-rotation apertures 64 correspond to four anti-rotation protuberances or "ears" 62 on the channel ring bushing 60. The ears 62 and the apertures 64 have similar size and shape. The ears 62 engage the apertures 64 to rotationally restrain the channel ring bushing 60. Preferably, the channel ring bushing 60 is a slightly loose fit into the diffuser 22, thereby easing the removal of the channel ring bushing 60. A complete bottom view of the channel ring bushing 60 is shown in FIG. 8.

Figure 6:
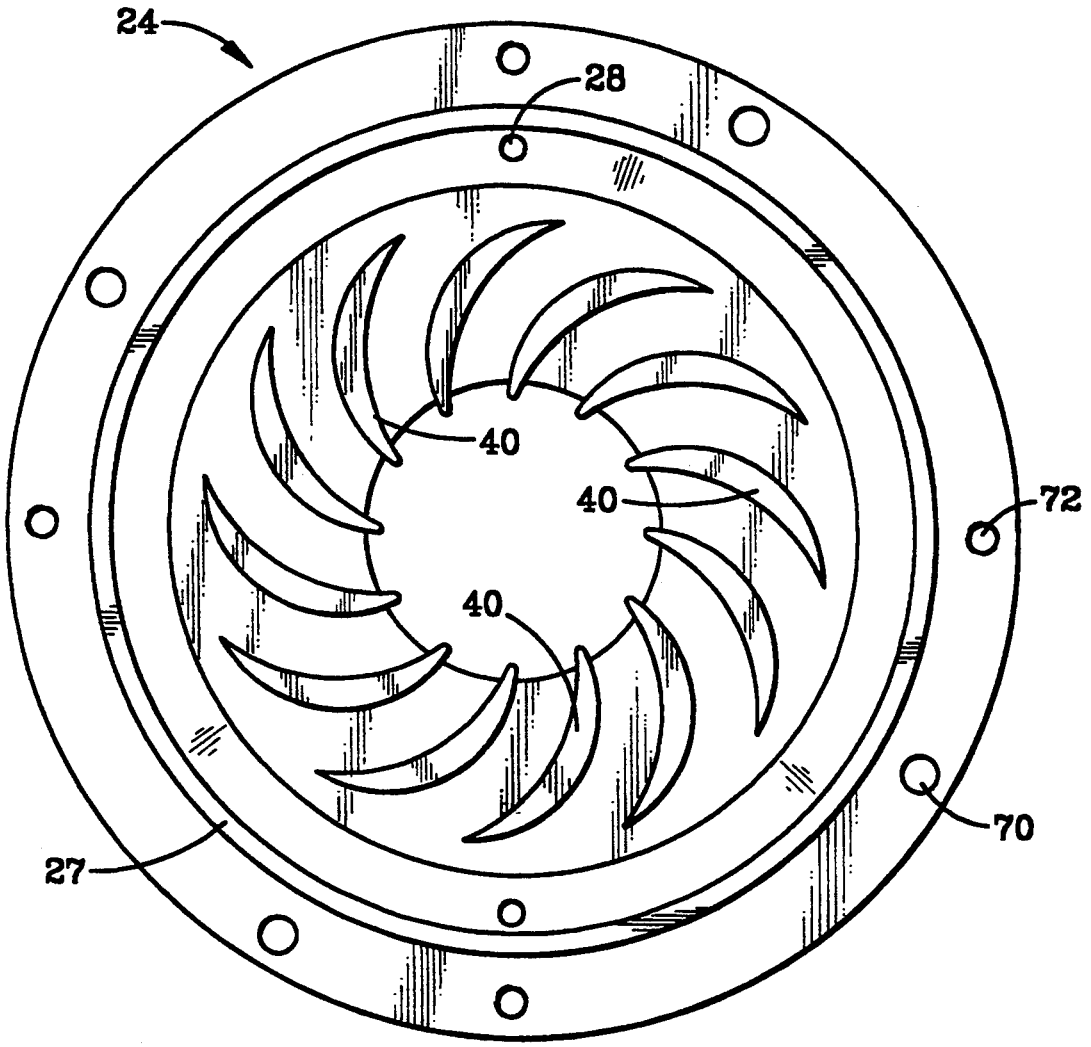
FIG. 6 is a top view of a channel ring.
Figure 7:
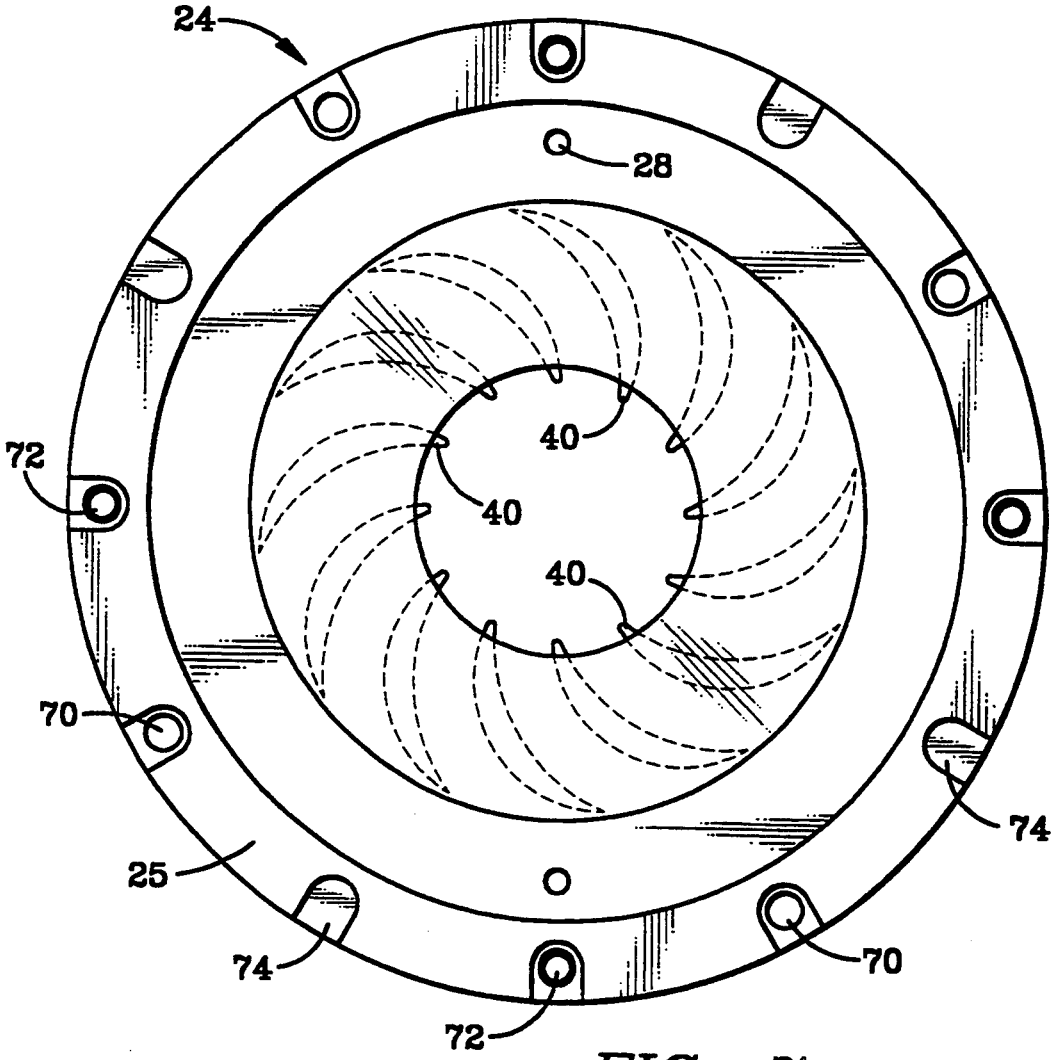
FIG. 7 is a bottom view of the channel ring shown in FIG. 6.
Figure 9:
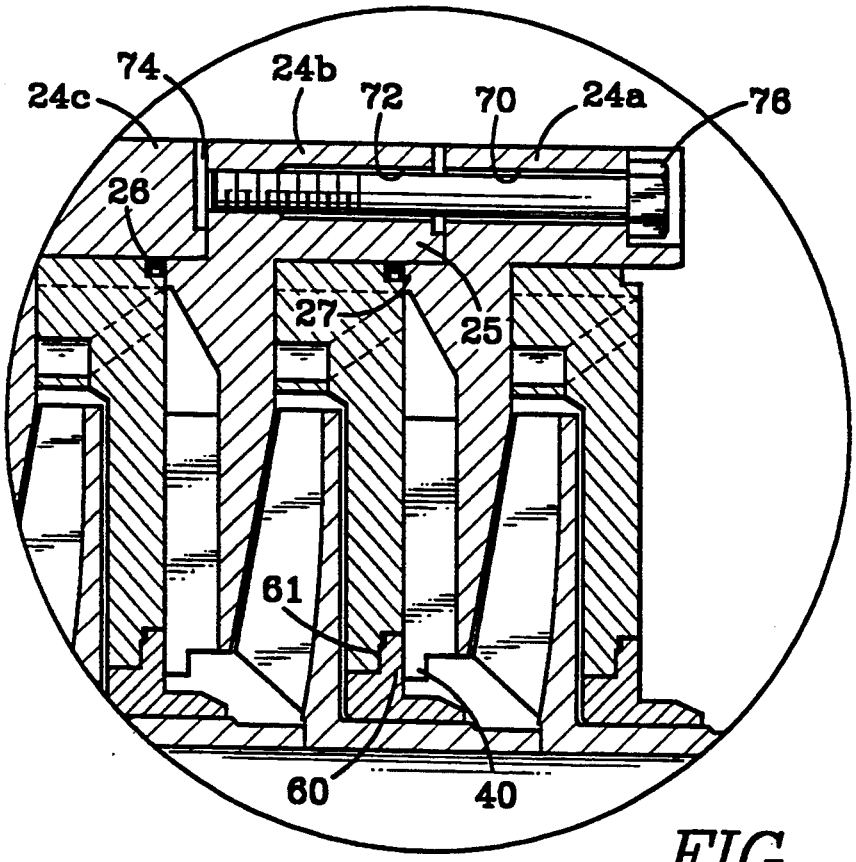
FIG. 9 is a partial cross-section of the internals of the multi-stage centrifugal pump shown in FIG. 1, showing the details of the channel ring bolting.

FIGS. 6 and 7 show a top view and bottom view, respectively, of a channel ring 24. The bottom face of the channel ring 24 has a raised portion defining a first circular rim 25. The inner diameter of the first circular rim 25 is slightly larger than the outer diameter of the diffuser 22. The axial thickness of the first circular rim 25 is greater than the axial thickness of the diffuser 22. As shown in FIGS. 2 and 9, this allows the diffuser 22 to nest between adjacent channel rings 24 with a "loose" fit. A load ring or spring 26 is used to bias the diffuser 22 into contact with a channel ring 24. This seals the diffuser passages 44 and prevents or reduces bypassing of pumped fluid from the diffuser 22.

A plurality of return vanes 40 are located on the top face of the channel ring 24. The top face of the channel ring 24 has a raised portion defining a second circular rim 27. The outer diameter of the second circular rim 27 is slightly smaller than the inner diameter of the first circular rim 25. This allows one channel ring 24 to nest into the adjacent channel ring 24 as shown in FIGS. 2 and 9. The second circular rim 27 radially locates one channel ring 24 relative to an adjacent channel ring 24.

Figure 11A:
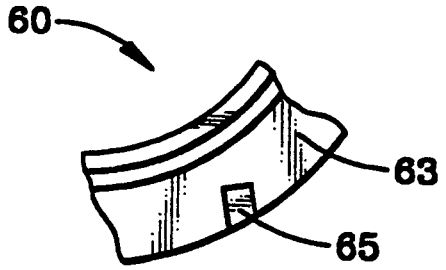
FIG. 11A is a bottom view of a portion of a channel ring bushing showing an alternate embodiment.
Figure 11B:
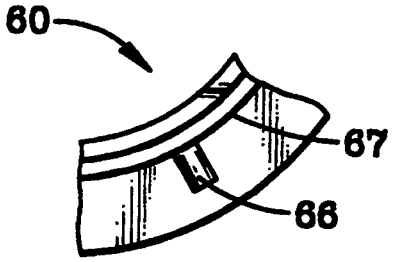
FIG. 11B is a bottom view of a portion of a channel ring bushing showing a second alternate embodiment.

An alternate embodiment of the channel ring bushing 60 is shown in FIG. 11A. Slots 65 are milled into the bottom face 63 of the channel ring bushing 60. The at least one slot 65 engages the tip of a channel ring return vane 40 to rotationally restrain the channel ring bushing 60. A second alternate embodiment of the channel ring bushing is shown in FIG. 11B. At least one pin 66 projects from the side of an extended nose portion 67 of the channel ring bushing 60. The at least one pin 66 extends between a pair of adjacent return vanes 40 to rotationally restrain the channel ring bushing 60.

As shown in FIGS. 2 and 9, the channel ring bushing 60 is axially restrained between an adjacent channel ring 24 and an adjacent diffuser 22. In the preferred embodiment, a shoulder 61 engages the diffuser 22 to limit axial movement in one direction and the bottom face 63 of the channel ring bushing 60 engages the tips of the return vanes 40 to limit axial movement in the other direction.

The first circular rim 25, shown in FIG. 7, has a series of holes 70 and a series of threaded apertures 72 therethrough and a series of recesses 74 thereon. Preferably the holes 70 are equally spaced from one another, the threaded apertures 72 are equally spaced from one another and the recesses 74 are equally spaced from one another. Each hole 70 is spaced a fixed circumferential distance from an adjacent threaded aperture 72 or recess 74. The fixed circumferential distance for the channel ring 24 shown in the FIGURES is 30°.

When the channel rings 24 are assembled in the pump casing 3, each channel ring 24 is rotated 30° relative to the adjacent channel ring 24. As shown in FIG. 9, threaded apertures 72 in channel ring 24*b* are aligned with the holes 70 in channel ring 24*a* to the right and are aligned with the recesses 74 with channel ring 24*c* to the left. A plurality of bolts 76 are inserted into holes 70 of channel ring 24*a* and threaded into the threaded apertures 72 in the adjacent channel ring 24*b*, thereby fastening the channel rings 24*a* and 24*b* together.

The channel rings 24 of the present invention include a means for jacking the channel rings 24 apart during disassembly. Bolts 76 are removed from the channel ring holes 70. At this point, the channel rings are held together by any interference fit between the first circular rim 25 on channel ring 24*b* and the second circular rim 27 on the adjacent channel ring 24*a*. If there is an interference fit holding two channel rings 24 together, bolts 76 are inserted into threaded apertures 72 on channel ring 24*a*. The length of the bolts 76 is sufficient to extend through channel ring 24*a* and press against a recess 74 on the adjacent channel ring 24*b*. As the bolts 76 are threaded into and through the threaded apertures 72, the channel ring 24*a* is jacked away from the adjacent channel ring 24*b*.

Having described the invention, what is claimed is:

1. A multi-stage centrifugal pump comprising:

a pump housing having an inlet and an outlet; and a plurality of pump stages within the pump housing, each pump stage comprising a diffuser, a channel ring, a biasing means for biasing the diffuser into contact with the channel ring and a rotatable impeller;

each channel ring being a disk shaped member having a central opening therethrough, the outer periphery of the channel ring having a raised portion defining a first circular rim, the first circular rim having an inner diameter, the first circular rim having an axial thickness;

each diffuser being a disk shaped member having a central opening therethrough, the outer diameter of the diffuser being smaller than the inner diameter of the channel ring first circular rim, the outer diameter of the diffuser being larger than the diameter of the channel ring central opening, the axial thickness of the diffuser being smaller than the axial thickness of the channel ring first circular rim, the diffuser fitting with a non-interference fit within the first circular rim of the channel ring.

2. The multi-stage centrifugal pump according to claim 1, wherein the biasing means is a ring shaped spring positioned between the diffuser of one pump stage and the channel ring of an adjacent pump stage.

3. The multi-stage centrifugal pump according to claim 1, wherein the channel ring first circular rim is located on a first face of the channel ring, the channel ring has a raised portion on a second face of the channel ring defining a second circular rim, the outer diameter of the second circular rim being smaller than the inner diameter of the first circular rim, the second circular rim engaging the first circular rim of an adjacent channel ring thereby radially positioning the adjacent channel ring.

4. A multi-stage centrifugal pump comprising;

a pump housing having an inlet and an outlet;

a plurality of pump stages within the pump housing, each pump stage comprising a diffuser, a channel ring, a channel ring bushing and a rotatable impeller;

a restraint means for axially restraining each channel ring bushing; and an interengaging means for rotationally restraining each channel ring bushings, the interengaging means including each channel ring bushing having at least one first antirotation member thereon and each diffuser having at least one second antirotation member thereon, said second antirotation member having a complementary shape and size to said first antirotation member, said second antirotation member engaging said first antirotation member.

5. A multi-stage centrifugal pump comprising:

a pump housing having an inlet and an outlet;

a plurality of pump stages within the pump housing, each pump stage comprising a diffuser, a channel ring, a channel ring bushing and a rotatable impeller, each channel ring having a plurality of vanes; and a restraint means for axially restraining each channel ring bushing; and an interengaging means for rotationally restraining each channel ring bushing, the interengaging means including each channel ring bushing having at least one slot therein, said at least one slot engaging a channel ring vane.

6. A multi-stage centrifugal pump comprising:

a pump housing having an inlet and an outlet;

a plurality of pump stages within the pump housing, each pump stage comprising a diffuser, a channel ring, a channel ring bushing and a rotatable impeller, each channel ring having a plurality of vanes;

a restraint means for axially restraining each channel ring bushing; and an interengaging means for rotationally restraining each channel ring bushing, the interengaging means including each channel ring bushing having at least one pin protruding therefrom, said at least one pin engaging adjacent channel ring vanes.

7. A multi-stage centrifugal pump comprising:

a pump housing having an inlet and an outlet;

a plurality of pump stages within the pump housing, each pump stage comprising a diffuser, a channel ring, a channel ring bushing and a rotatable impeller, each channel ring bushing having a shoulder for engaging the adjacent diffuser, thereby limiting axial movement of the channel ring bushing;

a restraint means for axially restraining each channel ring bushing; and an interengaging means for rotationally restraining each channel ring bushing.

8. A multi-stage centrifugal pump comprising:

a pump housing having an inlet and an outlet;

a plurality of pump stages within the pump housing, each pump stage comprising a diffuser, a channel ring, a channel ring bushing and a rotatable impeller;

a restraint means for axially restraining each channel ring bushing, the restraint means including each channel ring bushing being axially restrained by an adjacent channel ring and an adjacent diffuser; and an interengaging means for rotationally restraining each channel ring bushing.

9. A multi-stage centrifugal pump comprising:

a pump housing having an inlet and an outlet;

a plurality of pump stages within the pump housing, each pump stage comprising a diffuser, a channel ring, each channel ring having a plurality of return vanes thereon, a channel ring bushing and a rotatable impeller;

each channel ring bushing being axially restrained by an adjacent diffuser and the return vanes on an adjacent channel ring; and each channel ring bushing having a plurality of first antirotation members thereon, each diffuser having a plurality of second antirotation members thereon, said second antirotation members having a complementary shape and size to said first antirotation members, said second antirotation members engaging said first antirotation members, thereby preventing rotation of the channel ring bushing.

10. A multi-stage centrifugal pump comprising:

a pump housing having an inlet and an outlet;

a plurality of pump stages within the pump housing, each pump stage comprising a diffuser, a channel ring and a rotatable impeller; and each channel ring being a disk shaped member having a central opening therethrough, the outer periphery of the channel ring having a raised portion defining a first circular rim, the first circular rim having a series of holes therethrough, a series of threaded apertures therethrough, and a series of recesses spaced thereabout, the holes being equally spaced from one another, the apertures being equally spaced from one another, the recesses being equally spaced from one another, a hole being circumferentially positioned from an adjacent threaded aperture, a predetermined circumferential distance and being circumferentially positioned from an adjacent recess by said predetermined circumferential distance, a first channel ring being removably attached to an adjacent second channel ring by a plurality of bolts inserted through said holes in said first channel ring and engaging said threaded apertures in said second channel ring.

11. The multi-stage centrifugal pump according to claim 10, wherein the plurality of said bolts is removable from said holes in said first channel ring and said threaded apertures in said second channel ring for engagement with said threaded apertures in said first channel ring, the length of each bolt being sufficient to extend through said first channel ring to press against said recesses in said second channel ring thereby forcing said first channel ring away from said second channel ring as said bolts are threaded through said threaded apertures in said first channel ring.

12. The multi-stage centrifugal pump according to claim 10, wherein said predetermined circumferential distance is 30°.

13. The multi-stage centrifugal pump according to claim 10, wherein the channel ring first circular rim is located on a first face of the channel ring, the first circular rim has an inner diameter, the channel ring has a raised portion on a second face of the channel ring defining a second circular rim, the outer diameter of the second circular rim being smaller than the inner diameter of the first circular rim, the second circular rim engaging the first circular rim of an adjacent channel ring thereby radially positioning the adjacent channel ring.

* * * * *